United States Patent [19]

Farris et al.

[11] Patent Number: 4,739,844

[45] Date of Patent: Apr. 26, 1988

[54] HAMMER DRILL BIT AND SUB-ASSEMBLY

[75] Inventors: Oscar E. Farris, Longmont; Larry C. Nielsen, Aurora, both of Colo.

[73] Assignee: Becker Drills, Inc., Commerce City, Colo.

[21] Appl. No.: 940,932

[22] Filed: Dec. 12, 1986

Related U.S. Application Data

[63] Continuation of Ser. No. 820,708, Jan. 17, 1986, abandoned, which is a continuation of Ser. No. 595,838, Apr. 2, 1984, abandoned.

[51] Int. Cl.[4] ..... E21B 10/02

[52] U.S. Cl. ..... 175/215; 175/403

[58] Field of Search ..... 175/215, 249, 254, 403, 175/404, 405

[56] References Cited

U.S. PATENT DOCUMENTS

| | | | |
|---|---|---|---|
| 3,095,053 | 6/1963 | Pistole et al. | 175/404 |
| 3,509,953 | 5/1970 | Becker | 175/405 |
| 3,524,511 | 8/1970 | Klemm | 175/405 |
| 3,858,671 | 1/1975 | Kita et al. | 175/410 |
| 3,981,371 | 9/1976 | Wallis | 175/403 |

*Primary Examiner*—Stephen J. Novosad
*Assistant Examiner*—William P. Neuder
*Attorney, Agent, or Firm*—Klaas & Law

[57] ABSTRACT

A cylindrical hammer drill bit with a central fluid passage and having a first group of circumferentially spaced lowermost cutting surfaces located on lowermost arcuate segments spaced by elongated upwardly extending circumferentially spaced slots and a second group of circumferentially spaced uppermost cutting surfaces located in intermediate arcuate segments at the upper end of the slots. Each of the cutting surfaces has an arcuate segment portion on the outer periphery of the drill bit formed at the intersection of upwardly inwardly sloping surfaces with the periphery of the drill bit; and radially inwardly upwardly inclined radial segment portions located on radially rib portions on the upwardly inwardly sloping surfaces. Each radial rib portion is connected to an elongated inwardly facing fluid slot.

16 Claims, 3 Drawing Sheets

HAMMER DRILL BIT AND SUB-ASSEMBLY

This application is a continuation of prior applications, Ser. No. 595,838 filed Apr. 2, 1984 and Ser. No. 820,708 filed Jan. 17, 1986, the benefit of which is claimed herein, now abandoned.

BACKGROUND OF INVENTION

This invention relates to a drill bit and sub-assembly for use with a reverse circulation hammer type drill pipe.

Conventional reverse circulation hammer drill bits have generally been unable to provide a high consistency of recovery of core samples throughout the depth of the drilling operation. Lack of consistent air flow and pressure through the central return has caused inconsistent recovery of samples which has resulted, in many cases, in incorrect and misleading mineral content assays of the sample. Additionally, the design of conventional hammer drill bits has resulted, not only in lack of consistency of recovery of core samples, but also in inefficiency in drilling.

The primary object of the present invention is to improve consistency of recovery of core samples and efficiency of drilling. The primary object is achieved by improvements in the construction and design of the drill bit and sub-assembly which improve cutting and removal of chips and maintenance of air pressure in the inner pipe.

DETAILED DESCRIPTION

Figure 1:
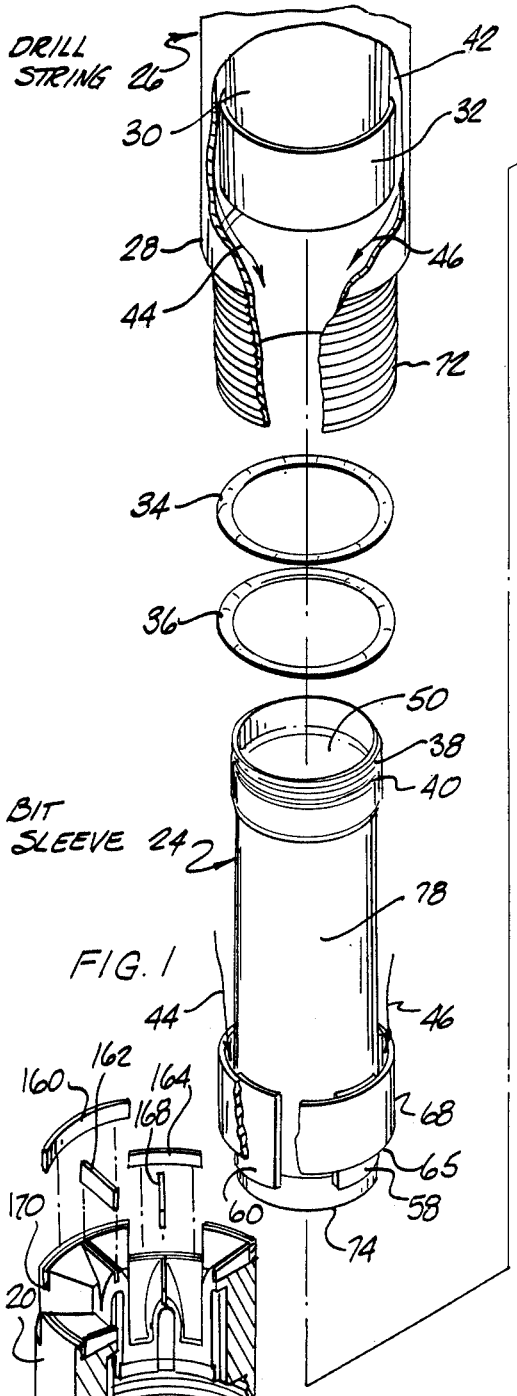
FIG. 1 is an exploded isometric sectional view of the drill bit and sub-assembly of the present invention.

As shown in FIG. 1, the drill bit assembly comprises a drill bit 20, known as a Selcon bit, which is connected to the downhole end of a bit sub-connector means 22 which is, in turn, connected to the downhole end of the outer pipe 28 of a section of dual wall drill string 26. The inner pipe 30 of drill string 26 is coupled to bit sleeve 24 by a connector sleeve means 32 which fits over O-rings 34, 36 which are mounted in grooves 38, 40, respectively on bit sleeve 24.

In operation, one or more sections of drill string 26 are raised and lowered by a conventional hammer drill type rig to reciprocably drive the drill bit 20 into the earth to cut a drill hole. Compressed air or other fluid under pressure to forced down the outer passage 42 of the dual wall drill string sections, as indicated by arrows 44, 46, and into a central cavity 48 in the drill bit 20, which is connected to center passage 50 of bit sleeve 24 through a center passage in inner pipe 30. Thus, loose bits and pieces of earthen materials are carried upwardly to the surface by air pressure where they can be analyzed and evaluated.

The drill bit 20 comprises a one-piece member made from a casting of metallic material such as 4100 to 4300 series steel. Bit sleeve 24 and bit sub 22 are machined from 4140 or 4300 series steel tubing. Drill bit 20 and bit sub 22 are case hardened by electrical induction or sand base hardening to a hardness of between 35 and 50 on the Rockwell scale. The upper end of drill bit 20 is provided with a large diameter bore having threads 52 for connection to the lower threaded end portion 54 of the bit sub 22. The lower end portion of drill bit 20 is provided with a reduced diameter bore which provides an annular seat 76 abutting against lower surface 74 of bit sleeve 24. Annular seal and shock ring 62 is disposed on annular flange 64 to provide an air tight seal between the bottom surface 65 of annular ring 68 and the inner wall of bit sub 22 to ensure passage of air as indicated by arrows 44, 46 and to absorb shock from bit sleeve 24.

Bottom surface portion 74 of bit sleeve 24 abuts against surface 76 such that air passing between the outer wall surface 78 at bit sleeve 24 and annular ring 68 flow through notched air passage means 80, 82 which extend through shortened and elongated cutting teeth 84, 86, respectively. Threaded portion 70 of bit sub 22 engages threaded portion 72 of drill string 26 for assembly of the drill bit assembly illustrated in FIG. 1.

Figure 2:
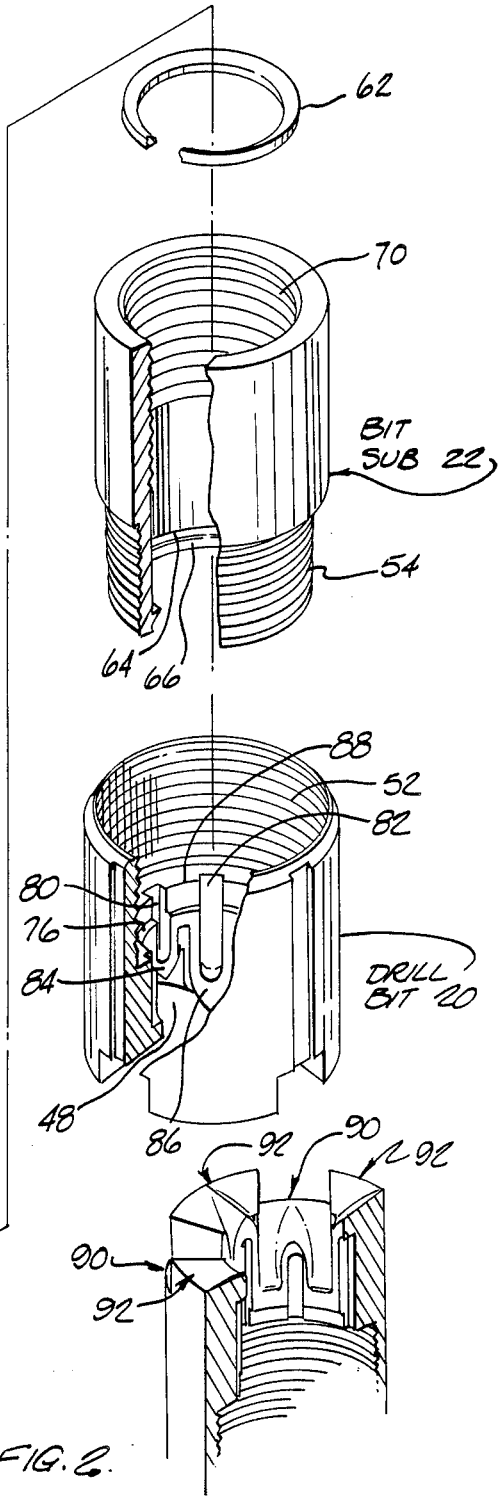
FIG. 2 is a sectional view of the drill bit of the present invention.

FIG. 2 illustrates a plurality of circumferentially and alternately spaced shortened intermediate cutting means 90 located on an intermediate side wall portion of the drill bit and elongated lowermost cutting means 92 on the lower end portion of the drill bit. Each shortened intermediate and elongated lowermost cutting means have shortened and elongated cutting teeth 84, 86, respectively, with notched air passage means formed therein for enabling compressed air to flow into central cavity 48, as set forth above.

Figure 3:
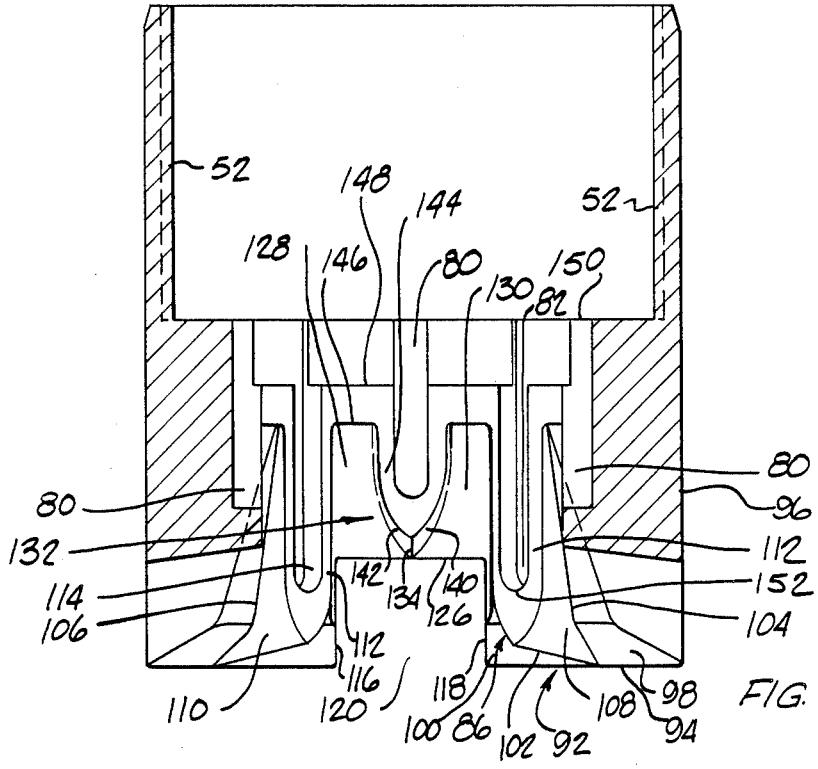
FIG. 3 is an enlarged cross-sectional view of the drill bit.
Figure 4:
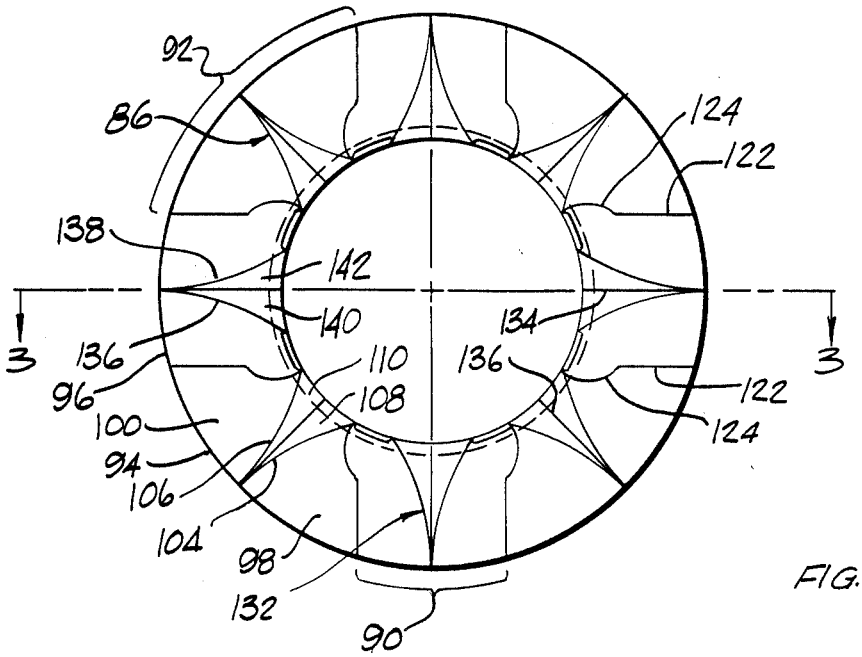
FIG. 4 is an end view of the drill bit of FIG. 3.

FIGS. 3 and 4 illustrate axially extended cutting means 92 which comprises an arcuate segmental peripheral cutting edge means 94 formed by the intersection of annular drill bit outer surface 96 and beveled surfaces 98, 100 located on opposite sides of a radially inwardly extending rib portion forming elongated cutting tooth 86 having an upwardly and inwardly sloping cutting edge 102. Each cutting tooth 86 has flat circumferentially spaced axially extending side surfaces 104, 106 connected by curved end surfaces 108, 110 which intersect to form cutting edge 102. Each cutting tooth 86 also has arcuate segmental inner surfaces 112. Air passage means 82 are centrally located in cutting tooth 86 and open through surfaces 112. Each axially extended cutting means is further defined by axially extending side wall portions 116, 118 which define lateral circumferentially spaced gaps 120 therebetween. Surfaces 116, 118 comprise a flat parallel outermost portion 122 and a concave innermost portion 124.

Each axially shortened cutting means 90 comprises an arcuate segmental peripheral cutting edge portion 126 formed by the intersection of annular outer drill bit surface 96 and slightly beveled surfaces 128, 130 located on opposite sides of a radially inwardly extending cutting tooth 132 having a laterally inwardly sloping cutting edge 134 on the lower end thereof. Each cutting tooth 132 has flat circumferentially spaced axially extending side surfaces 136, 138 connected by curved end surfaces 140, 142 which intersect to form cutting edge 134. Each rib portion also has arcuate segment and inner surfaces 144 defining circumferentially spaced portions of bore 48. Air passage means 80 are centrally located in cutting tooth 132 and open through surfaces 144.

Each of the cutting teeth 86, 132 extend downwardly in the drilling position from a common plane 146 spaced downwardly from surface 148 a relatively short axial distance. Each of the air passages 80, 82 begin at annular lateral surface 150 which defines the end of threaded portion 52. Air passages 82 extend axially downwardly beyond cutting surfaces 126 with a lowermost portion 152 located radially opposite gaps 120 below lateral surfaces 128, 130. Thus, gaps 120 provide the additional function of air flow between adjacent ones of the axially extended cutting means. The oppositely curved side walls 124 form pockets to facilitate collection of cuttings and facilitate flow of cuttings into central cavity 48 and upwardly into connector tube passage 50.

In the presently preferred embodiment, the angles of the beveled surfaces 98, 100, 128, 130 are approximately 65 degrees from the vertical axis of the drill bit. The angle of cutting edges 102, 134 is approximately 83 degrees from the vertical axis of the drill bit. Thus, the drill bit provides a plurality of axially extended lowermost cutting means circumferentially disposed on circumferentially spaced lowermost arcuate segmental side wall portions which are of uniform size and shape and which have opposite parallel circumferentially spaced side surfaces forming a plurality of uniform size and shape circumferentially spaced radially inwardly and axially upwardly extending end slots spaced around the periphery of the drill bit and extending radially between the generally cylindrical outer peripheral surface portion of the drill bit and the generally cylindrical central opening extending axially through the drill bit; and a plurality of axially shortened intermediate cutting means axially upwardly spaced from the axially extended lowermost cutting means and disposed on circumferentially spaced arcuate intermediate segmental sections of the drill bit of uniform size and shape which are located axially adjacent and in part define the end slots and are disposed between the opposite parallel circumferentially spaced side surfaces of the lowermost segmental portions.

Figure 5:
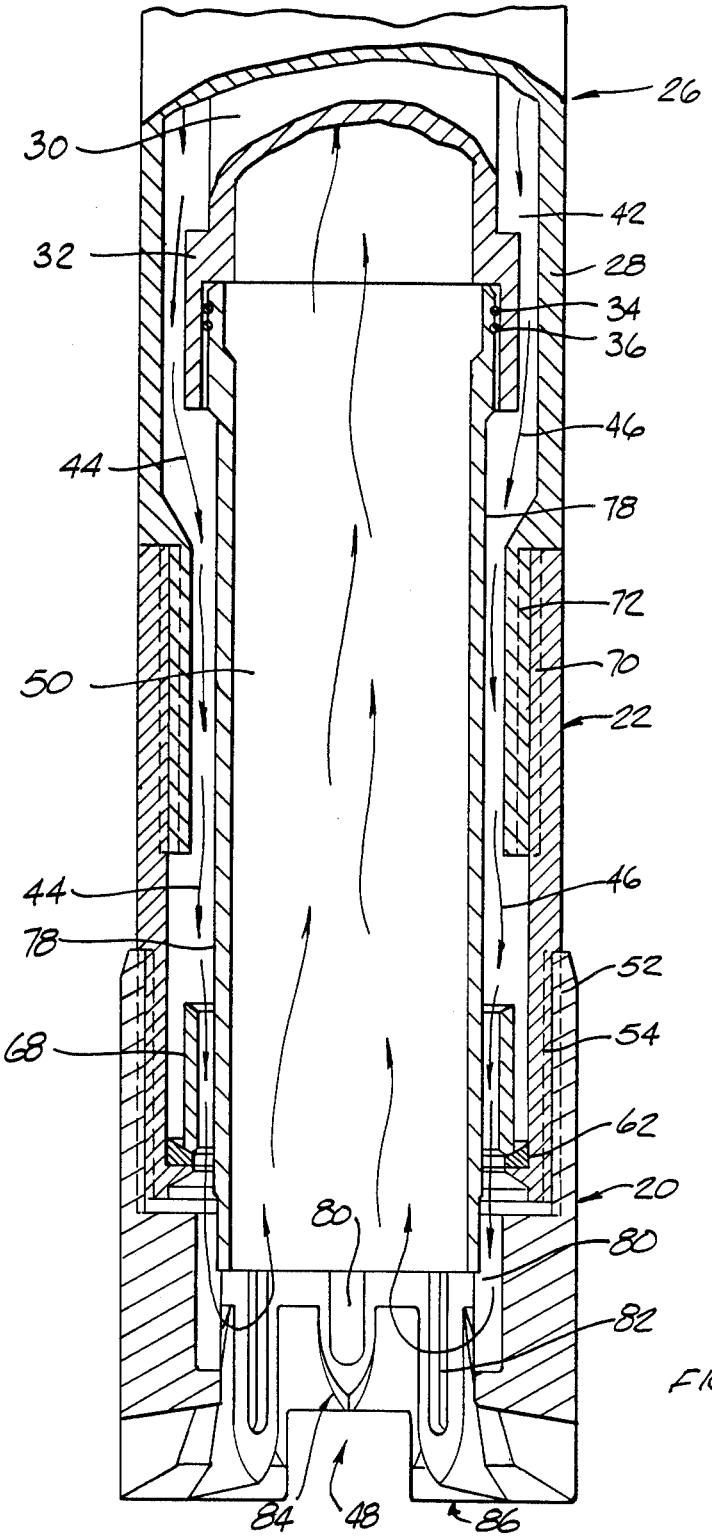
FIG. 5 is a cross-section of a drill bit and sub-assembly of the present invention.

FIG. 5 is a cutaway assembly drawing of the drill bit assembly of the present invention in an assembled configuration. Drill string 26 is attached to bit sub 22 by way of threaded portions 72 of drill string 26 and threaded portions 70 of bit sub 22. In a similar manner, bit sub 22 is coupled to drill bit 20 by way of male threaded portions 54 of bit sub 22 and female threaded portions 52 of drill bit 20. Bit sleeve 24 is disposed in the central opening formed by the assembly of drill bit 20, but sub 22 and drill string 26. Bit sleeve 24 is disposed between flange portion 32 of inner pipe 30 and annular seal 62 disposed in bit sub 22. Bit sleeve 24 forms an annular cylindrical cavity having a center passage 50 for movement of air and collected bit samples in an upward direction. Bit sleeve 24 separates center passage 50 from external air passage 42. O-rings 34, 36 provide an airtight seal between outer passage 42 and center passage 50. Air is pumped down the outer passageway 42 of the drill string from the surface and proceeds along the outer passage as indicated by arrows 44, 46. Air passes between the inner surface of annular ring 68 and outer surface 78 of bit sleeve 24 into notched portions 80, 82 of cutting teeth 84, 86. Annular ring 62 provides an airtight seal between annular ring 68 and the inner wall of bit sub 22 and absorbs shock transmitted by bit sleeve 24.

The configuration of air passage means 80, 82 directs the airflow in an inward and upward direction to provide a more consistent air return. Both pressure and velocity of the air return remain more constant during the drilling process because of the inward and upward angle at which the air is directed through air passages 80, 82. The air medium functions to blow the sample away from the cutting edges of the bit and direct the sample through opening 48 into the void area of central passage 50 such that the sample is directed along the path of least resistance through central passage 50. In this manner, the consistency of the sample by volume is constant during the entire drilling process so as to provide a sample of mineral content which remains constant with vertical drilling depth. This is of high importance in exploratory drilling, especially of desert aluvials and placer exploration, to accurately determine mineral content of samples to accumulate data for the purpose of evaluating the feasibility of a mining operation. Failure to efficiently and consistently return the sample to the surface may affect the accuracy of the percentage per ton of rare metals of the sample retrieved during the drilling process.

The present invention also provides extra cutting edge. The axially shortened cutting means 90 provides room for expansion of samples which have been cut by axially extended cutting means 92 until the sample is removed through central opening 50. The cutting edges are beveled to increase the feed angle and to streamline the removal of sample from the cutting surfaces during the drilling process. The angle of the cutting edges provides for more cutting edge as the cutting process proceeds into the cut material. Moreover, the design of the present invention provides for additional cutting teeth to further increase the efficiency of the hammer drill bit of the present invention.

Figure 6:
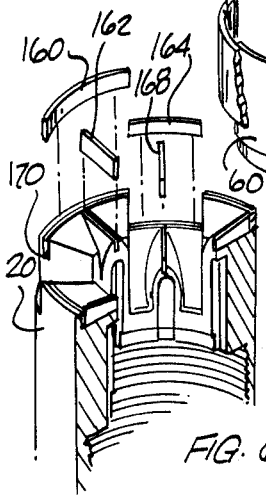
FIG. 6 is an alternative embodiment illustrating carbide inserts used in conjunction with the hammer drill bit of the present invention

FIG. 6 illustrates an alternative embodiment which utilizes carbide inserts 160, 162, 164, 168 adjacent cutting edges in drill bit 20. Each of the carbide inserts is inserted into a groove such as groove 170 adjacent the cutting edge and secured in place by gluing or other suitable means of attaching the carbide inserts in the grooves. The carbide inserts function to increase the hardness of the cutting edges and consequently extend the effective use of the drill bit and premature wear of the cutting edges. The grooves in the cutting edges are machined in drill bit 20 prior to the hardening process. Once the grooves are machined in the drill bit 20, the surfaces are case hardened by electrical induction, as described above.

The foregoing description of the invention has been presented for purposes of illustration and description. It is not intended to be exhaustive or to limit the invention to the precise form disclosed, and other modifications and variations may be possible in light of the above teachings. The embodiment was chosen and described in order to best explain the principles of the invention and its practical application to thereby enable others skilled in the art to best utilize the invention in various embodiments and various modifications as are suited to the particular use contemplated. It is intended that the appended claims be construed to include other alternative embodiments of the invention except insofar as limited by the prior art.

What is claimed is:

1. A hammer drill bit for efficiently and consistently cutting and removing drilling samples in use with dual wall drilling pipe having concentric outer and inner pipe members comprising:

a plurality of axially extended lowermost cutting means circumferentially disposed on circumferentially spaced lowermost arcuate segmental side wall portions of the drill bit which are of uniform size and shape having opposite parallel circumferentially spaced side surfaces forming a plurality of uniform size and shape circumferentially spaced radially inwardly and axially upwardly extending end slots spaced around the periphery of said drill bit and extending radially between a generally cylindrical outer peripheral surface portion of the drill bit and a generally cylindrical central opening extending axially through the drill bit, each of said axially extended lowermost cutting means comprising:

lowermost flat beveled surface means formed on said lowermost arcuate segmental portions at the lowermost end of the drill bit and extending radially inwardly between said outer peripheral surface portion and said central opening and having an inward and upward slope to facilitate the flow of said samples cut by said axially extended lowermost cutting means into a lower portion of said central opening at a first beveled surface means angle of vertical inclination;

lowermost arcuate outer peripheral cutting edge means located at the intersection of said outer peripheral surface portion and said lowermost flat beveled surface means;

lowermost radially extending cutting teeth means centrally disposed on said lowermost flat beveled surface means and having an elongated axially extending portion having an inner curved surface which is concentric with and defines a portion of said central opening and a radially extending portion with a pair of curved side surfaces which intersect to form a radial cutting edge portion extending in a radially inward and upward direction from said outer peripheral cutting edge means to said central opening at a first cutting tooth angle of greater vertical inclination than said first bevel surface means angle of inclination;

first notched axially extending air passage means formed in said inner curved surface of said elongated axially extending portion of said lowermost radially extending cutting teeth means for directing air in a radially inward and upward direction to provide consistent velocity and pressure of air flow into said central opening to remove samples from the cutting surfaces of the drill bit and direct the samples into said central opening for removal and recovery;

a plurality of axially shortened intermediate cutting means axially upwardly spaced from said axially extended lowermost cutting means and disposed on circumferentially spaced arcuate intermediate segmental sections of the drill bit of uniform size and shape located axially adjacent and in part defining said end slots and disposed between said opposite parallel circumferentially spaced side surfaces of said lowermost segmental portions, each of said axially shortened intermediate cutting means comprising:

intermediate flat beveled surface means formed on the lowermost end portion of said arcuate intermediate segmental sections of said axially shortened intermediate cutting means and located between said opposite parallel circumferentially spaced side surfaces of said lowermost arcuate segmental portions and extending radially inwardly between said outer peripheral surface portion and said central opening and having an inward and upward slope to facilitate the flow of samples into an intermediate portion of said central opening at a second beveled surface means angle of vertical inclination;

intermediate arcuate outer peripheral cutting edge means located at the intersection of said outer peripheral surface portion and said intermediate beveled surface means and extending between said opposite parallel circumferentially spaced side surfaces of said lowermost arcuate segmental portions;

said intermediate arcuate outer peripheral cutting edge means and said intermediate beveled surface means and said axially extending opposite parallel side surfaces of said lowermost arcuate segmental portions defining said end slots and forming a generally rectangular opening between said axially extended cutting means to allow expansion of samples which have been cut by said axially extended lowermost cutting means prior to removal through said central opening;

uppermost radially extending cutting teeth means centrally disposed on said intermediate flat beveled surface means and having an elongated axially extending portion having an inner curved surface which is concentric with and defines a portion of said central opening and a radially extending portion with a pair of curved side surfaces which intersect to form a radial cutting edge portion extending in a radially inward and upward direction from said intermediate arcuate outer peripheral cutting edge means and said central opening at a second cutting tooth angle of greater vertical inclination than said second bevel surface means angle of inclination;

second notched air passage means formed in said inner curved surface of said elongated axially extending portion of said uppermost radially extending cutting teeth means for directing air in a radially inward and upward direction to provide consistent velocity and pressure of air flow into said central opening to remove samples from cutting surface of said drill bit and direct said samples into said central opening for removal and recovery; and each of said inner curved surfaces of each of said lowermost radially extending cutting teeth means and said uppermost radially extending cutting teeth means being concentric with one another and defining concentric peripheral surface portions of said central opening.

2. The invention as defined in claim 1 and wherein:

each of said lowermost flat beveled surface means extend continuously from the outer peripheral surface of the drill bit to the inner peripheral surfaces of the central opening at a common angle of inclination in a common conical plane; and each of said lowermost radially extending cutting edge portions extend from the outer peripheral surface of the drill bit to the inner peripheral surfaces of the central opening at a common angle of inclination and are located in a common conical plane.

3. The invention as defined in claim 1 or 2 and wherein:

said lowermost arcuate segmental portions have a greater circumferential length than said arcuate intermediate segmental sections.

4. The invention as defined in claim 3 and wherein:

said lowermost arcuate segmental portions and said arcuate intermediate segmental sections having a common radial thickness with concentric outer peripheral surfaces and concentric inner peripheral surfaces.

5. The invention as defined in claim 4 and wherein:

each of said radial cutting edge portions of said lowermost radially extending cutting teeth means and said uppermost radially extending cutting teeth means being of the same size and shape 6. The invention as defined in claim 1 or 2 wherein reversed curved pocket means are formed at the intersection of said lowermost cutting teeth means and said lowermost flat beveled surface means for facilitating collection of the samples and flow of the samples into said central opening.

7. The invention as defined in claim 5 wherein said predetermined first and second beveled surface means angle is approximately 65 degrees from the vertical axis of the drill bit; and said first and second cutting tooth angle are approximately 83 degrees from the vertical axis of the drill bit.

8. The invention as defined in claim 5 wherein said lowermost and intermediate arcuate outer peripheral cutting edge means have carbide inserts disposed adjacent thereto to increase hardness and limit wear of said outer peripheral cutting edge means; and said cutting edge portions of said lowermost and uppermost radially extending cutting teeth means have carbide inserts disposed adjacent thereto to increase hardness and limit wear of said cutting edge portions.

9. A drill bit for use with dual wall drill pipe having an outer pipe member and a concentric inner pipe member which provide an annular outer passage for supplying air to the drill bit and an annular inner sample passage for upward passage of air and sample materials from the ground comprising:

a generally cylindrical body member made of one piece of metallic material and having a generally cylindrical outer peripheral configuration with an upper portion having radially outermost threaded connecting means for connecting the drill pipe to the outer pipe member and radially innermost connecting means for connecting the drill bit to the inner pipe member;

a central generally cylindrical passage means in said body member having a diameter approximately equal to the inside diameter of the inner pipe member for enabling upward flow of air and ground material from the drill bit to and through the inner pipe member;

a first relatively large size counterbore means in said upper portion of said body member for providing a first radially outwardly extending annular surface having a plurality of circumferentially spaced axially downwardly extending air inlet passages extending therethrough for delivering air to said central passage means;

a second relatively small size counterbore means axially downwardly offset from said first relatively large size counterbore means for providing a second annular radially extending surface for receiving a connecting sleeve means having an inside diameter approximately equal to the inside diameter of the inner pipe member;

a plurality of equally circumferentially spaced axially upwardly extending slot means in the lowermost portion of said body member for enabling flow of ground material into said central passage means and being defined by opposed parallel flat side surfaces and outer peripheral arcuate edge surfaces extending therebetween and providing a plurality of equally spaced lowermost arcuate segment portions on the lowermost end portion of said body member and a plurality of equally spaced intermediate arcuate segment portions on an intermediate portion of said body member;

each of said lowermost and said intermediate arcuate segment portions having arcuate outer side wall surfaces which are concentric with said central opening and arcuate inner wall surfaces which are concentric with said central opening;

each of said lowermost segment portions having lowermost beveled surfaces and each of said intermediate arcuate segment portions having uppermost beveled surfaces which are radially inwardly and upwardly inclined to provide outer peripheral cutting edge portions thereon;

each of said lowermost and intermediate arcuate segment portions having an axially and radially inwardly extending rib portion centrally located thereon; and each rib portion comprising:

an axially extending inner curved surface portion which is concentric with said central opening;

a lowermost generally triangular-shape lower end portion having oppositely curved side surfaces which intersect along a radially outwardly extending line to form a radially inwardly axially upwardly inclined cutting edge portion and have a point of intersection circumjacent said outer peripheral cylindrical surface; and an axially elongated radially inwardly facing air slot means in said inner curved surface portion for receiving air from said air inlet passage means and delivering air to said central passage means.

10. The invention as defined in claim 9 and wherein:

each of said lowermost beveled surfaces and said uppermost beveled surfaces extend continuously from the outer peripheral surface of the drill bit to the inner peripheral surfaces of said central passage means at a common angle of inclination in a common conical plane.

11. The invention as defined in claim 10 and wherein:

each inclined cutting edge portion on the rib portions extend from the outer peripheral surface of the drill bit to the inner peripheral surfaces of the central opening at a common angle of inclination and are located in a common conical plane.

12. The invention as defined in claims 9 or 10 or 11 and wherein:

said lowermost arcuate segment portions have a greater circumferential length than said arcuate intermediate segment portions.

13. The invention as defined in claim 22 and wherein:

said lowermost arcuate segment portions and said arcuate intermediate segment portions having a common radial thickness with concentric outer peripheral surfaces and concentric inner peripheral surfaces.

14. The invention as defined in claim 12 and wherein: each rib portion and inclined cutting edge portion being of the same size and shape.

15. The invention as defined in claims 9 or 10 or 11 wherein reversed curved pocket means are provided on said lowermost arcuate segment portions adjacent the rib portion for facilitating collection of the samples and flow of the samples into said central opening.

16. The invention as defined in claim 15 further comprising:

carbide inserts mounted adjacent said outer peripheral cutting edge portions and said radially extending cutting edge portions to increase hardness and limit wear of said cutting edge portions.

* * * * *